US010273077B2

(12) United States Patent
Vanni et al.

(10) Patent No.: US 10,273,077 B2
(45) Date of Patent: Apr. 30, 2019

(54) CAPSULE, MACHINE, SYSTEM AND METHOD FOR PREPARING BEVERAGE, PARTICULARLY ESPRESSO COFFEE

(75) Inventors: Alfredo Vanni, Magliolo (IT); Alberto Cabilli, Moncalieri (IT)

(73) Assignee: LUIGI LAVAZZA S.P.A., Turin (IT)

( * ) Notice: Subject to any disclaimer, the term of this patent is extended or adjusted under 35 U.S.C. 154(b) by 357 days.

(21) Appl. No.: 14/119,979

(22) PCT Filed: May 31, 2012

(86) PCT No.: PCT/IB2012/052743

§ 371 (c)(1),
(2), (4) Date: Nov. 25, 2013

(87) PCT Pub. No.: WO2012/164521

PCT Pub. Date: Dec. 6, 2012

(65) Prior Publication Data

US 2014/0090564 A1 Apr. 3, 2014

(30) Foreign Application Priority Data

May 31, 2011 (IT) ..... TO2011A0478

(51) Int. Cl.
*B65D 85/804* (2006.01)
*B65D 65/46* (2006.01)

(52) U.S. Cl.
CPC ..... *B65D 85/8046* (2013.01); *B65D 65/466* (2013.01); *B65D 85/8043* (2013.01)

(58) Field of Classification Search
CPC ..... B65D 85/8043; B65D 85/8046
USPC ..... 99/295, 323; 426/77–84, 115, 394
See application file for complete search history.

(56) References Cited

U.S. PATENT DOCUMENTS 1,555,515 A * 9/1925 Peal ..... B65D 85/808 426/77
3,095,801 A 7/1963 Fogg
3,309,980 A 3/1967 Bozek
4,806,369 A * 2/1989 Thompson ..... B65D 85/812 206/15
5,582,731 A * 12/1996 Gianfranco ..... B65D 85/8043 206/0.5

(Continued)

FOREIGN PATENT DOCUMENTS

EP 0 584 314 A1 3/1994
EP 2 141 093 A1 1/2010

OTHER PUBLICATIONS

International Search Report for PCT/IB2012/052743 dated Sep. 7, 2012.

*Primary Examiner* — Ibrahime A Abraham
*Assistant Examiner* — John J Norton
(74) *Attorney, Agent, or Firm* — Sughrue Mion, PLLC

(57) ABSTRACT

A capsule (1) including a casing (2) having first and second end walls (3, 4) spaced one from the other and interconnected by a lateral wall (5) having an essentially annular shape, and defining an internal chamber (6) containing an amount or dose of a substance (7) for the preparation of a beverage. The casing (2) has at least one first and at least one second permeable or pierceable wall portion (5*a*, 4*a*), acting as inlet and outlet, respectively, for the introduction of a flow of water into said chamber (6) and the outflow of the beverage from said chamber (6), respectively. An inlet wall portion (5*a*) for the introduction of water into the chamber (6) is provided in the annular lateral wall (5).

24 Claims, 6 Drawing Sheets

(56) References Cited

U.S. PATENT DOCUMENTS

| | | | | |
|---|---|---|---|---|
| 7,946,217 | B2 * | 5/2011 | Favre | A47J 31/0668 426/433 |
| 8,443,717 | B2 * | 5/2013 | Venturi | B65D 85/8043 426/77 |
| 8,960,079 | B2 * | 2/2015 | Gugerli | A47J 31/401 99/275 |
| 8,986,766 | B2 * | 3/2015 | Bernhardsgruetter | A47J 31/3614 222/71 |
| 2010/0003371 | A1 * | 1/2010 | Ozanne | B65D 85/8043 426/77 |
| 2010/0077928 | A1 | 4/2010 | Schmed et al. | |
| 2010/0203198 | A1 * | 8/2010 | Yoakim | A47J 31/22 426/80 |

* cited by examiner

CAPSULE, MACHINE, SYSTEM AND METHOD FOR PREPARING BEVERAGE, PARTICULARLY ESPRESSO COFFEE

CROSS REFERENCE TO RELATED APPLICATIONS

This application is a National Stage of International Application No. PCT/IB2012/052743, filed on May 31, 2012, which claims priority from Italian Patent Application No. TO2011A000478, filed on May 31, 2011, the contents of all of which are incorporated herein by reference in their entirety.

BACKGROUND OF THE INVENTION

Field of the Invention

The present invention relates in a general way to systems for preparing beverages, particularly espresso coffee, using capsules or the like containing a substance for preparing the beverage, particularly ground roast coffee.

Background

The present invention relates primarily to a capsule of the type comprising:

- a casing having first and second end walls spaced apart from each other and interconnected by a lateral wall having an essentially annular shape, and defining an internal chamber containing an amount or dose of a substance for the preparation of a beverage;
- the casing having at least one first and at least one second permeable or pierceable wall portion, acting as inlet and outlet, respectively, for the introduction of a flow of water into said chamber and the outflow of the beverage from said chamber, respectively.

Capsules of this type, which can be used, in particular, for preparing espresso coffee, are disclosed, for example, in patents EP-0 584 314 B1 and EP-2 141 093 B1, both in the name of the present applicant.

Known capsules of the type defined above have a casing, typically of cylindrical or frusto-conical shape, wherein the substance for preparing the beverage forms what is known as a filter panel of corresponding shape. In a capsule of this type, the hot pressurized water is introduced at one of the two end faces of the capsule, and the beverage flows out at the other end face.

The wall of the capsule through which the hot pressurized water is introduced and the wall through which the beverage flows out can be of the water-permeable type or of the type which can be pierced by any suitable known piercing devices.

In these capsules, the annular lateral wall is completely impermeable and is not pierced during the preparation of the beverage.

With capsules of the known type described above, it is important to ensure optimal wetting of the filter panel formed by the dose of substance contained in the capsule, in order to achieve optimal extraction of the beverage. For this purpose, it must be ensured that the entry of the hot pressurized water into the capsule takes place over a wide flow area or cross section.

In capsules of the known types produced up to the present time, the maximum area of introduction of the water into the capsule is no greater than the area of the end surface or wall, which is typically circular, through which the water is introduced.

An increase in the diameter of this surface of wall for the purpose of improving the wetting of the substance contained in the capsule is not feasible in practice, because, for a given internal volume of the capsule, it requires a considerable reduction in the height of the capsule, with negative effects on the characteristics of the contact between the water and the substance contained in the capsule.

A first object of the present invention is therefore to provide a capsule which can overcome the drawbacks of the prior art capsules described above, and which, in particular, improves the wetting of the substance contained in the capsule.

SUMMARY OF THE INVENTION

This object is achieved according to the invention with a capsule of the type defined in the introduction, characterized in that an inlet wall portion for the introduction of water into the capsule is made in the aforesaid lateral wall of essentially annular shape.

The pressurized water can be introduced into the capsule according to the invention either solely through one of the one or more portions of the annular lateral wall thereof, or through this annular lateral wall and also partially through one of the end surfaces or walls of the capsule.

Further advantageous features of the capsule according to the invention are defined in the dependent claims.

The present invention also proposes a machine for preparing beverages by using a capsule as described herein, the salient features of this machine being described herein.

In a machine for preparing a beverage according to the invention, the infusion chamber is configured in such a way that it can define, with respect to the capsule positioned therein, an annular space extending around the portion of the lateral wall of the capsule intended to allow the introduction of water into the capsule, this space being connected to the pressurized water supply means, and being separated in a liquid-tight manner from the discharge means provided for the outflow of the beverage formed in the infusion chamber towards a collecting container.

The present invention also proposes a system for preparing a beverage which comprises a capsule and a machine as described herein.

Finally, the invention also includes a method for preparing a beverage.

BRIEF DESCRIPTION OF THE DRAWINGS

Further features and advantages of the invention will be made clear by the following detailed description, provided purely by way of non-limiting example, with reference to the attached drawings, in which.

DETAILED DESCRIPTION OF THE INVENTION

Figure 1:
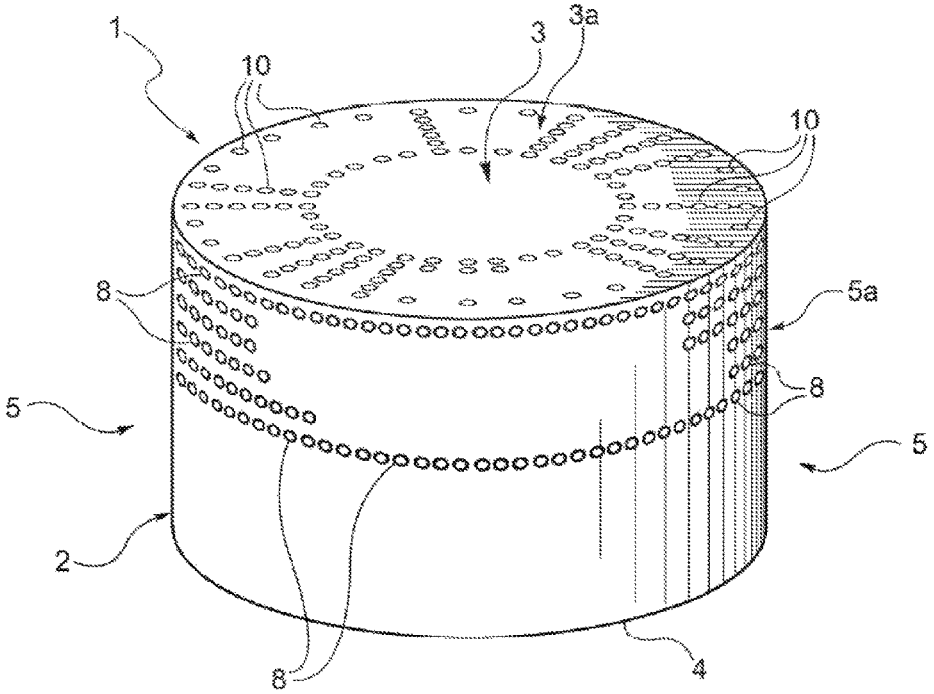
FIG. 1 is a perspective view of a first capsule for preparing a beverage according to the present invention.

In FIG. 1, the number 1 indicates the whole of a capsule according to the present invention for preparing a beverage such as espresso coffee.

The capsule 1 of FIG. 1 comprises a casing 2, made for example of food grade plastic material.

In the illustrated embodiment, the casing 2 has a generally cylindrical configuration, with a first and a second end wall 3, 4, at the top and bottom respectively, spaced apart from each other and interconnected by a lateral wall 5 of essentially annular shape.

The casing 2 can also be made in a non-cylindrical shape such as a frusto-conical shape.

Figure 2:
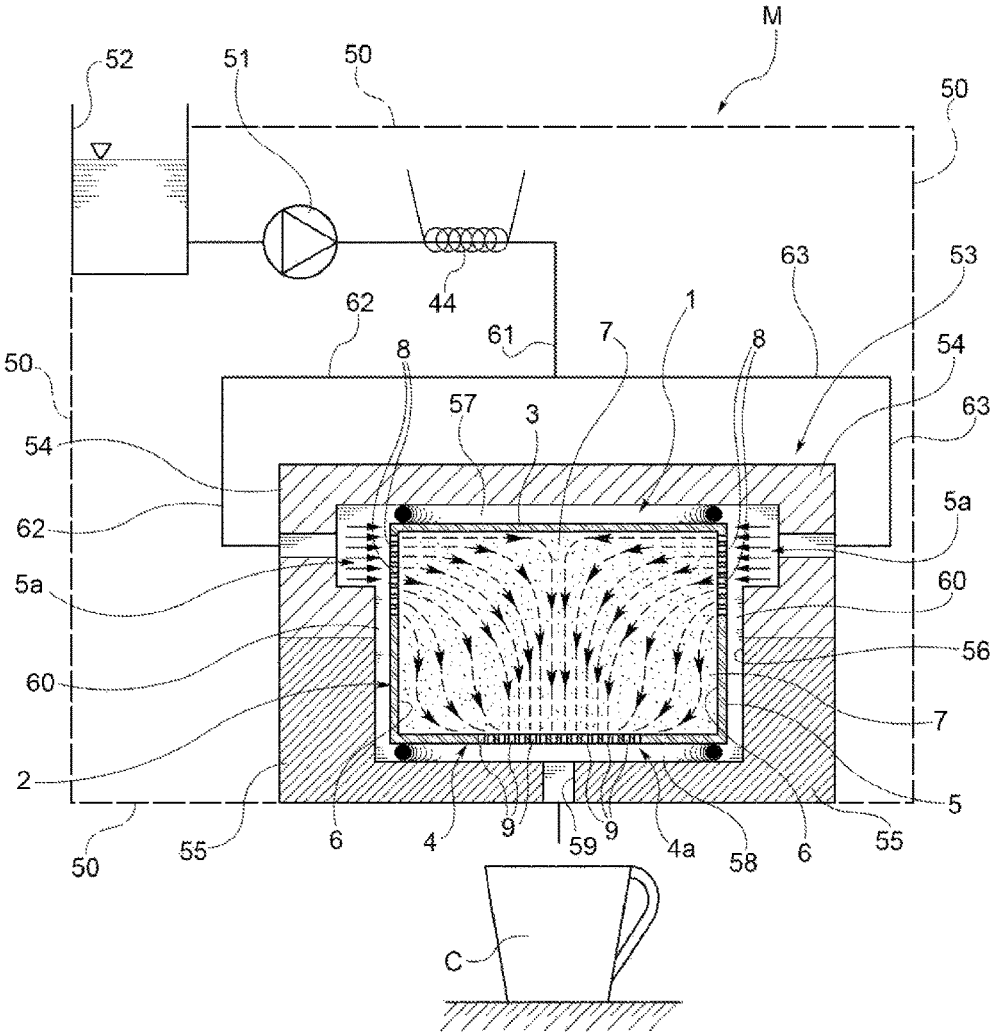
FIG. 2 is a schematic representation of a machine for preparing a beverage according to the invention, using a capsule according to FIG. 1.

As shown in FIG. 2, the casing 2 defines an internal region or chamber 6, which contains an amount or dose of a substance 7 for preparing a beverage, such as ground roast coffee.

The annular lateral wall 5 of the casing 2 has an upper portion 5*a* having a plurality of micro-holes 8 to make it water-permeable. The micro-holes 8 can each have a cross section such that they impede the outflow from the casing 2 of the substance contained therein for preparing the beverage, and/or a filter, made for example of paper or the like, can be placed inside the casing 2, immediately adjacent to the inner surface of the lateral wall 5, for retaining the aforesaid substance in the casing 2.

At least one portion, preferably a central portion, of the lower end wall 4 of the casing 2 is also preferably provided with micro-holes, indicated by 9 in FIG. 2, such that said wall portion is made permeable to the liquid beverage formed by the contact of the substance 7 contained in the capsule with the water introduced thereinto through the inlet portion 5*a* of the lateral wall 5 of the capsule.

FIG. 2 shows schematically a machine M which can be used for preparing a beverage, using a capsule 1 of the type described above with reference to FIG. 1.

In the illustrated embodiment, the machine M comprises a support casing 50 in which an electric pump 51 can be actuated in a known way to cause water to flow from a reservoir 52 towards an infusion unit indicated as a whole by 53, after passing through an electric heater device 44 of a known type.

The infusion unit 53 can comprise two elements 54 and 55 which can be moved away from and towards each other, and which can be connected in a sealed way in order to form, in combination, an infusion chamber 56 into which a capsule 1 of the type described above has previously been introduced.

In the schematically illustrated embodiment, the element 54 of the infusion unit 53 carries a toroidal sealing ring 57, and the element 55 carries a sealing ring 58. The arrangement is such that the capsule 1 introduced into the infusion unit 53 is enclosed longitudinally between the sealing rings 57 and 58. In particular, the ring 58 extends around the central portion 4*a* of the lower wall 4 of the capsule in which the outflow micro-holes 9 are provided.

The infusion chamber 56 is configured so as to define, relative to the capsule 1 enclosed therein, an annular space 60 which extends around the lateral wall 5 of the capsule, and in particular around the portion 5*a* of this wall in which are provided the micro-holes 8 for the introduction of the water.

The space 60 is connected to the delivery end of the pump 51 through one or more conduits such as those indicated by 61-63 in FIG. 2.

In the lower element 55 of the infusion unit 53, the region inside the sealing ring 58 communicates with a discharge passage 59, through which, in use, the beverage flowing out of the capsule 1 through the micro-holes 9 in the lower base of the capsule can pass to a collecting container such as a cup C placed beneath.

The arrangement of the machine M shown schematically in FIG. 2 is such that, as a result of the activation of the pump 51 and the heating device 44, a flow of hot pressurized water is sent into the space 60, from where it penetrates into the casing 2 of the capsule 1 through the micro-holes 8 in the inlet wall portion 5*a* of its annular lateral wall 5.

Streams of hot water in the substance 7 contained in the capsule 1 are indicated in broken lines, for guidance only, in FIG. 2. The paths shown here indicate how the substance 7 can be effectively "wetted", thus allowing optimal infusion.

With reference to FIG. 1, a further inlet portion of wall can be provided in the upper end wall 3 of the casing 2 for the introduction of pressurized water into the casing. In the embodiment shown in broken lines in FIG. 1, this further inlet portion of wall is indicated by 3*a*, and is essentially in the form of a circular ring comprising a plurality of micro-holes indicated by 10.

In order to use a capsule which is further provided with a ring of inlet micro-holes 10 as described immediately above, the infusion unit 53 of the machine M according to FIG. 2 must be provided with an upper sealing ring 57 with a suitably reduced diameter.

In variant embodiments which are not illustrated, the micro-holed portion 3*a* of the upper end wall 3 of the capsule 1 can be central, instead of peripheral as shown in the exemplary embodiment of FIG. 1.

Ultimately, it is possible for the whole upper end wall 3 of the capsule 1 to be micro-holed, but in any case the flow cross section through this wall 3 is preferably smaller than the flow cross section through the micro-holed portion 5*a* of the lateral wall 5 of the capsule.

Figure 3:
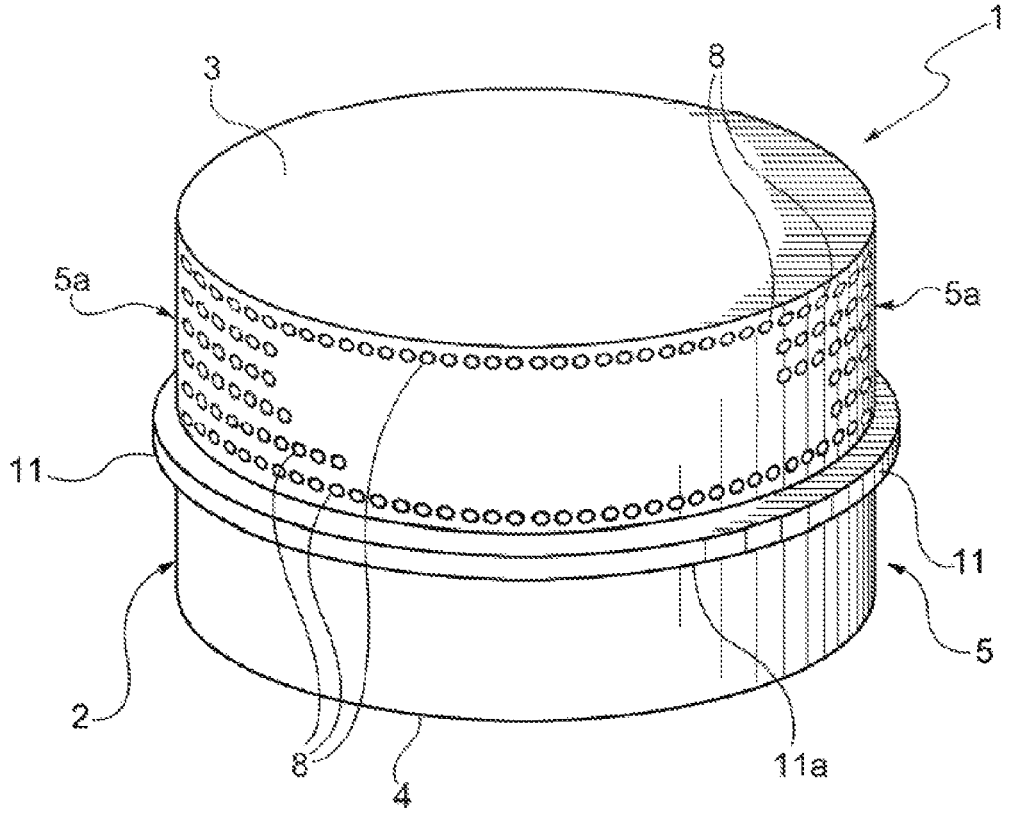
FIG. 3 is a perspective view of a variant embodiment of the capsule according to FIG. 1.

FIG. 3 shows a further variant embodiment of the capsule 1 according to the present invention. In this drawing, parts and elements described previously have been given the same reference numerals as those used previously.

Figure 4:
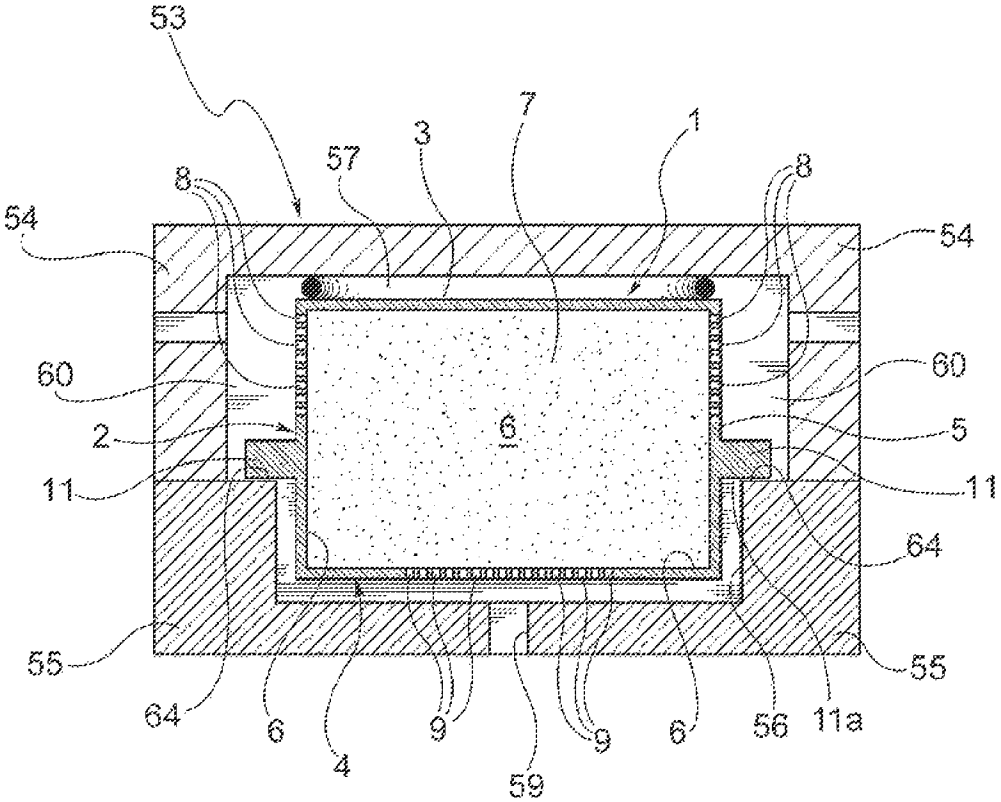
FIG. 4 is a partial sectional view showing the infusion chamber of a machine for preparing a beverage according to the invention, using a capsule according to FIG. 3.

In the variant according to FIG. 3, the annular lateral wall 5 of the casing 2 of the capsule has an outer peripheral projection 11, whose lower annular surface or face 11*a* forms a transverse shoulder intended to abut in an essentially watertight way against a corresponding bearing surface 64 (FIG. 4) provided in the infusion chamber 56 of the infusion unit 53 in which the capsule 1 is intended to be used. As seen in FIG. 4, the connection by abutment of the peripheral projection 11 of the capsule 1 against the surface 64 of the infusion chamber creates the watertight separation between the space 60 and the beverage discharge conduit 59.

The upper end wall 3 of the capsule according to FIG. 3 can also be provided with micro-holes, if required, to assist the introduction of hot pressurized water into the capsule.

Figure 5:
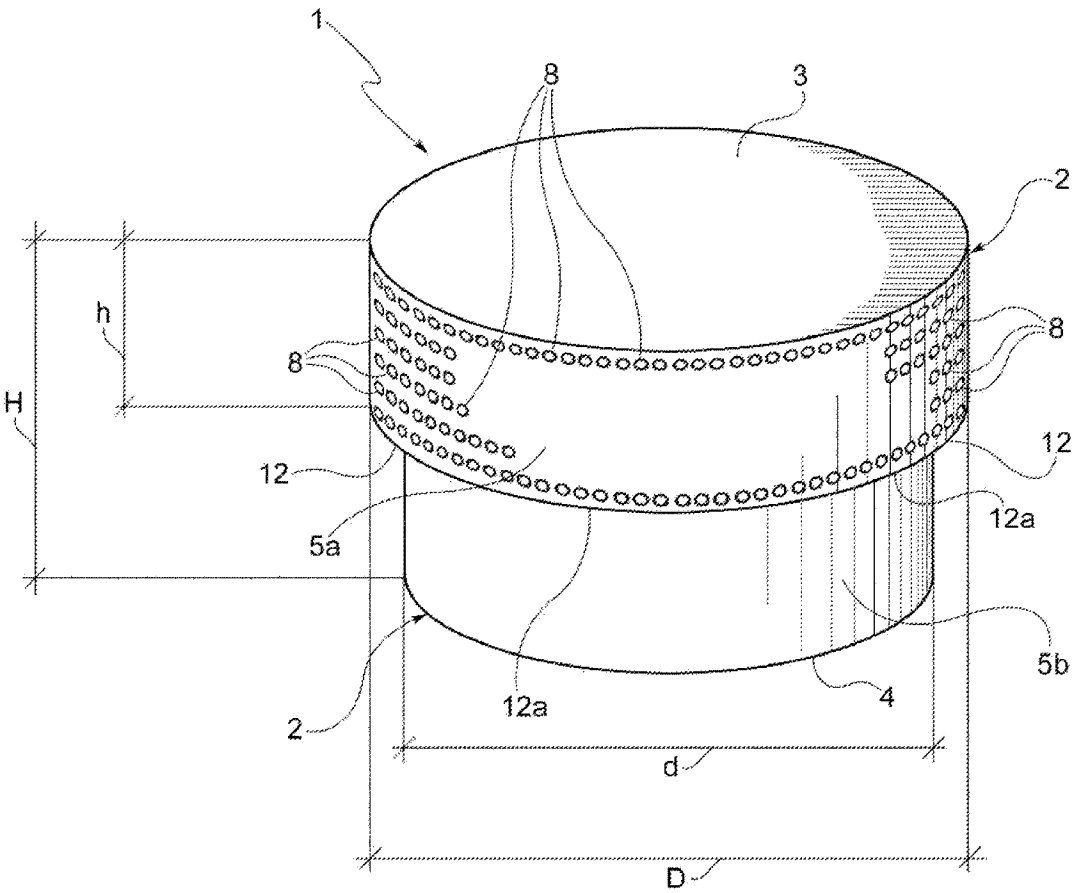
FIG. 5 is a perspective view of another variant embodiment of a capsule according to the invention.

FIG. 5 shows a further variant embodiment of a capsule 1 according to the invention. In this drawing also, parts and elements described previously have again been given the same reference numerals as those used previously.

In the capsule 1 according to FIG. 5, the lateral wall 5 of the casing 2 has a cross-sectional profile which forms a step 12, which defines an external annular surface or transverse shoulder 12*a* facing downward. The step 12 has the effect of dividing the lateral wall 5 of the casing into an upper portion 5*a* having a greater cross section and a lower portion 5*b* having a smaller cross section.

The shoulder 12*a* defined at the step 12 provides the same sealing function in the infusion chamber as that provided by the peripheral projection 11 of the capsule described above with reference to FIGS. 3 and 4.

The capsule according to FIG. 5 can also have a micro-holed area in the upper end wall 3, for the additional introduction of hot pressurized water into the capsule.

Conveniently, in the capsule according to FIG. 5, the ratio between the height h of the upper portion 5*a* and the overall height H of the capsule is in the range from 0.1 to 0.9. Additionally, the ratio between the diameter d of the portion 5*b* and the diameter D of the portion 5*a* is also in the range from 0.1 to 0.9.

In all cases, the ratio between the overall flow area or cross section of the introduction of the water into a capsule 1 according to the invention and the area or cross section of the outflow of the beverage from the capsule is preferably greater than 1.

Figure 6:
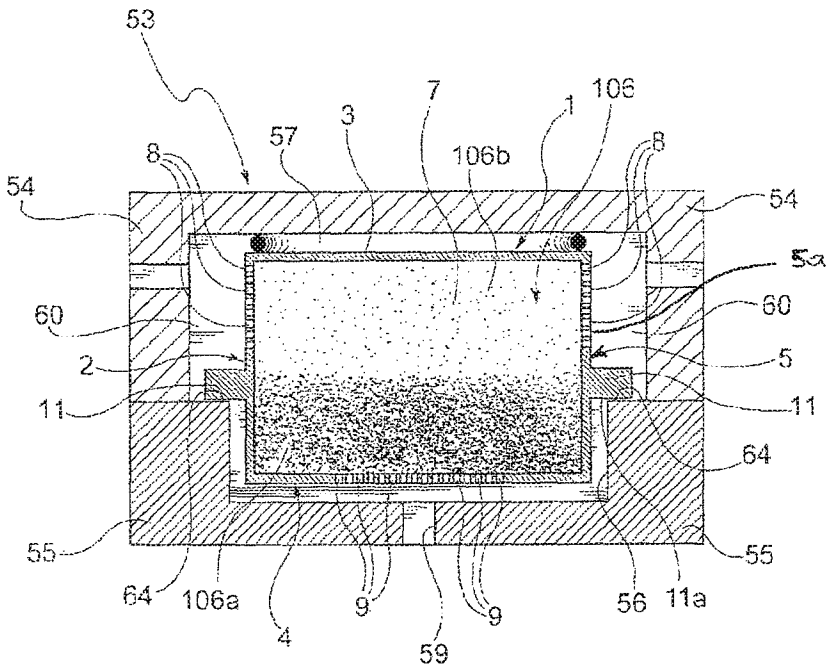
FIG. 6 is a partial sectional view showing the infusion chamber of a machine for preparing a beverage according to another variant of the invention.

Referring to FIG. 6, in the various embodiments of a capsule according to the invention, the substance 7 for preparing beverages is preferably in the form of granules or a powder, and is deposited so as to form a stratified structure 106 in the capsule 1, with a more dense and compact lower layer 106*a* and a less dense upper layer 106*b* adjacent to the inlet wall portion 5*a* for the introduction of the water. This solution makes it possible to improve the diffusion of the "precursor" of the beverage into the capsule.

The inlet wall portion 5*a* can be made, if required, with a film or sheet welded around the casing 2 and capable of being pierced or torn by points, blades or the like for the introduction of the water into the chamber 6.

In general, since the capsule 1 can easily be made of a single material, shaped into the final profile by injection moulding, forging, embossing or injection-compression moulding operations, the capsule 1 can conveniently be made of a biodegradable/compostable material, and in particular a polymer material, preferably a polymer extracted from biomass or a compostable synthetic polymer, or a polymer produced by genetically modified micro-organisms or bacteria, or a polymer made from fossil monomers, or a material containing natural fibres as by-products of the food chain (husks of maize, coffee, rice, or the like) or lawn mowing products, conglomerated by means of a binding agent, or a polymer blend.

Clearly, provided that the principle of the invention is retained, the forms of application and the details of construction can be varied widely from what has been described and illustrated purely by way of non-limiting example, without thereby departing from the scope of protection of the invention as defined by the attached claims.

The invention claimed is:

1. A capsule for preparing a beverage, comprising a casing having first and second lateral end walls vertically spaced apart from each other and interconnected by an external lateral wall having an annular shape, said first and second walls being a top wall and a bottom wall of the capsule, respectively, and defining an internal chamber containing an amount or dose of a substance for the preparation of a beverage;

said casing having an inlet portion and an outlet portion separate from each other and acting as inlet and outlet, respectively, for introduction of a flow of water into the capsule and outflow of the beverage from the capsule, respectively;

wherein the inlet portion is provided in said external lateral wall and wherein the outlet portion is provided in said second end wall of the casing, wherein one further inlet portion for the introduction of water into the capsule is provided in said first end wall of the casing, and wherein said further inlet portion has a flow area or cross section smaller than that of the inlet portion provided in the external lateral wall, such that the introduction of water into the capsule occurs mainly through said external lateral wall.

2. The capsule according to claim 1, wherein the outlet portion is provided in a central portion of said second end wall of the casing.

3. The capsule according to claim 1, wherein the external lateral wall of the casing forms a transverse shoulder intended to abut in a watertight way against a corresponding surface of an infusion chamber of a machine for the preparation of the beverage.

4. The capsule according to claim 3, wherein the external lateral wall of the casing has a peripheral external projection which defines said transverse shoulder.

5. The capsule according to claim 3, wherein the external lateral wall of the casing has an axial cross-sectional profile which forms at least one step which externally defines said transverse shoulder and divides the casing into a first portion having a greater cross section and a second portion having a smaller cross section.

6. A capsule for preparing a beverage, comprising:

a casing having first and second lateral end walls vertically spaced apart from each other and interconnected by an external lateral wall having an annular shape, said first and second walls being a top wall and a bottom wall of the capsule, respectively, and defining an internal chamber containing an amount or dose of a substance for the preparation of a beverage;

said casing having an inlet portion and an outlet portion separate from each other and acting as inlet and outlet, respectively, for introduction of a flow of water into the capsule and outflow of the beverage from the capsule, respectively;

wherein the inlet portion is provided in said external lateral wall and wherein the outlet portion is provided in said second end wall of the casing, wherein the external lateral wall of the casing forms a transverse shoulder intended to abut in a watertight way against a corresponding surface of an infusion chamber of a machine for the preparation of the beverage, wherein the external lateral wall of the casing has an axial cross-sectional profile which forms at least one step which externally defines said transverse shoulder and divides the casing into a first portion having a greater cross section and a second portion having a smaller cross section, and wherein the ratio between the overall height (H) of the casing and the height (h) of the portion of the casing having the greater cross section is in the range from 0.1 to 0.9.

7. The capsule according to claim 6, wherein the inlet portion is provided only in said external lateral wall.

8. The capsule according to claim 6, wherein one further inlet portion for the introduction of water into the capsule is provided in said first end wall of the casing.

9. The capsule according to claim 8, wherein said further inlet portion has a flow area or cross section smaller than that of the inlet portion provided in the external lateral wall, such that the introduction of water into the capsule occurs mainly through said external lateral wall.

10. The capsule according to claim 6, wherein the outlet portion is provided in a central portion of said second end wall of the casing.

11. A capsule for preparing a beverage, comprising:

a casing having first and second lateral end walls vertically spaced apart from each other and interconnected by an external lateral wall having an annular shape, said first and second walls being a top wall and a bottom wall of the capsule, respectively, and defining an internal chamber containing an amount or dose of a substance for the preparation of a beverage;

said casing having an inlet portion and an outlet portion separate from each other and acting as inlet and outlet, respectively, for introduction of a flow of water into the capsule and outflow of the beverage from the capsule, respectively;

wherein the inlet portion is provided in said external lateral wall and wherein the outlet portion is provided in said second end wall of the casing, wherein the external lateral wall of the casing forms a transverse shoulder intended to abut in a watertight way against a corresponding surface of an infusion chamber of a machine for the preparation of the beverage, wherein the external lateral wall of the casing has an axial cross-sectional profile which forms at least one step which externally defines said transverse shoulder and divides the casing into a first portion having a greater cross section and a second portion having a smaller cross section, and wherein the end walls of the casing are circular, and the ratio between the diameters (d, D) thereof is in the range from 0.1 to 0.9.

12. The capsule according to claim 11, wherein the inlet portion is provided only in said external lateral wall.

13. The capsule according to claim 11, wherein one further inlet portion for the introduction of water into the capsule is provided in said first end wall of the casing.

14. The capsule according to claim 13, wherein said further inlet portion has a flow area or cross section smaller than that of the inlet portion provided in the external lateral wall, such that the introduction of water into the capsule occurs mainly through said external lateral wall.

15. The capsule according to claim 11, wherein the outlet portion is provided in a central portion of said second end wall of the casing.

16. A capsule for preparing a beverage, comprising:

a casing having first and second lateral end walls vertically spaced apart from each other and interconnected by an external lateral wall having an annular shape, said first and second walls being a top wall and a bottom wall of the capsule, respectively, and defining an internal chamber containing an amount or dose of a substance for the preparation of a beverage;

said casing having an inlet portion and an outlet portion separate from each other and acting as inlet and outlet, respectively, for introduction of a flow of water into the capsule and outflow of the beverage from the capsule, respectively;

wherein the inlet portion is provided in said external lateral wall and wherein the outlet portion is provided in said second end wall of the casing, and wherein the ratio between the total flow area or cross section for the introduction of water into the chamber and the outflow area or cross section of the beverage from the chamber is greater than 1.

17. The capsule according to claim 16, wherein the inlet portion is provided only in said external lateral wall.

18. The capsule according to claim 16, wherein one further inlet portion for the introduction of water into the capsule is provided in said first end wall of the casing.

19. The capsule according to claim 18, wherein said further inlet portion has a flow area or cross section smaller than that of the inlet portion provided in the external lateral wall, such that the introduction of water into the capsule occurs mainly through said external lateral wall.

20. The capsule according to claim 16, wherein the outlet portion is provided in a central portion of said second end wall of the casing.

21. The capsule according to claim 16, wherein the casing has a shape which is cylindrical.

22. The capsule according to claim 16, wherein the external lateral wall of the casing forms a transverse shoulder intended to abut in a watertight way against a corresponding surface of an infusion chamber of a machine for the preparation of the beverage.

23. The capsule according to claim 22, wherein the external lateral wall of the casing has a peripheral external projection which defines said transverse shoulder.

24. The capsule according to claim 22, wherein the external lateral wall of the casing has an axial cross-sectional profile which forms at least one step which externally defines said transverse shoulder and divides the casing into a first portion having a greater cross section and a second portion having a smaller cross section.

* * * * *